United States Patent [19]

Sasaki et al.

[11] Patent Number: 4,615,776

[45] Date of Patent: Oct. 7, 1986

[54] ELECTROLYTIC DECONTAMINATION PROCESS AND PROCESS FOR REPRODUCING DECONTAMINATING ELECTROLYTE BY ELECTRODEPOSITION AND APPARATUSES THEREFORE

[75] Inventors: Takashi Sasaki, Miki; Toshio Kobayashi, Kobe; Koichi Wada, Miki, all of Japan

[73] Assignee: Shinko-Pfaudler Company, Kobe, Japan

[21] Appl. No.: 661,696

[22] Filed: Oct. 17, 1984

[30] Foreign Application Priority Data

| | | | |
|---|---|---|---|
| Oct. 21, 1983 | [JP] | Japan | 58-198114 |
| Feb. 28, 1984 | [JP] | Japan | 59-037466 |
| Jun. 7, 1984 | [JP] | Japan | 59-117847 |

[51] Int. Cl.[4] ..... C25F 3/16

[52] U.S. Cl. ..... 204/129.1; 204/129.75; 204/130; 204/237; 204/263; 204/269; 204/301; 204/182.3

[58] Field of Search ..... 204/98, 112, 129.1, 204/129.35, 129.75, 129.95, 130, 149, 151, 180 R, 180 P, 232, 237, 253, 263, 269, 301

[56] References Cited

U.S. PATENT DOCUMENTS

| | | | |
|---|---|---|---|
| 1,590,596 | 6/1926 | Taylor et al. | 204/237 |
| 3,320,175 | 5/1967 | Podbererky et al. | 204/149 |
| 3,515,655 | 6/1970 | Raviv et al. | 204/145 R |
| 3,764,503 | 10/1973 | Lancy et al. | 204/151 |
| 4,056,482 | 11/1977 | Schmieder et al. | 204/149 |
| 4,193,853 | 3/1980 | Childs et al. | 204/129.95 |
| 4,226,695 | 10/1980 | Matson | 204/149 |
| 4,318,786 | 3/1982 | Lahoda et al. | 204/141.5 |
| 4,379,082 | 4/1983 | Gauchon | 204/237 |
| 4,401,532 | 8/1983 | Jackson | 204/129.1 |
| 4,468,305 | 8/1984 | Hillis | 204/151 |
| 4,481,089 | 11/1984 | Izumida et al. | 204/129.75 |
| 4,481,090 | 11/1984 | Childs | 204/129.75 |
| 4,514,270 | 4/1985 | Furutani et al. | 204/151 |

FOREIGN PATENT DOCUMENTS

| | | | |
|---|---|---|---|
| 1142776 | 2/1969 | United Kingdom | 204/141.5 |

*Primary Examiner*—John F. Niebling
*Assistant Examiner*—Terryence Chapman
*Attorney, Agent, or Firm*—Marshall, O'Toole Gerstein, Murray & Bicknell

[57] ABSTRACT

This disclosure relates to electrolytic decontamination of radioactively contaminated objects such as equipment or parts. The objects to be decontaminated are divided into two types: First, wastes resulting from dismantlement of radioactively contaminated equipment and parts, and second, equipment, vessels, pipes and tools that are to be reused. The electrolyte used for decontamination of the first type may be an inorganic acid aqueous solution of relatively low concentration that is inexpensive and rapid in polishing. A suitable inorganic acid is sulfuric acid that does not generate harmful gases in the process of electrolysis. The concentration of the sulfuric acid should be high to achieve polishing efficiency. About 5 Vol. % is the most suitable for uniform polishing and disposal of waste electrolyte. An electrolyte of this concentration is effective in macroscopic polishing but not in microscopic polishing (mirror finish), however. Therefore, an electrolyte for decontamination of the second type that requires microscopic polishing must be a high concentration acid solution, preferably 70% or higher phosphoric acid content. The electrolyte is reproduced by an electrodeposition process in diaphragm electrolysis.

25 Claims, 10 Drawing Figures

ELECTROLYTIC DECONTAMINATION PROCESS AND PROCESS FOR REPRODUCING DECONTAMINATING ELECTROLYTE BY ELECTRODEPOSITION AND APPARATUSES THEREFORE

BACKGROUND OF THE INVENTION

The present invention relates to a process for radioactive decontamination of metal by electrolytic polishing of the metal surface of radioactively contaminated equipment or parts used, for example, in nuclear plants or other facilities handling radioactive substances. It also relates to a process for recovering, by electrodeposition capture, radioactive metal ions in the form of solid metal, which ions dissolve in an electrolyte during the process of the electrolytic decontamination, and reproducing decontaminating electrolyte having the initial concentration.

Equipment, parts and piping used in nuclear plants are frequently contaminated by diffusion and deposition of radioactive conjugated oxides (which may be called "CRUD") and other radioactive substances as the plants are operated.

Radioactively contaminated equipment can be decontaminated by blasting the equipment with ice or dry ice, a high pressure jet of water, ultrasonic cleaning, chemical polishing or electrolytic polishing. The electrolytic polishing is the most advantageous method in respect to decontamination and prevention of recontamination, but it presents some problems in the disposal of waste electrolyte.

The major portion of the radioactive substances that contaminate metals is contained in the CRUD. The CRUD is composed of radioactive conjugated oxides which are hard to dissolve in an electrolyte. In an electrolytic polishing process, it is possible to separate the CRUD by allowing a DC current to flow between one or more cathodes and an anode formed by the contaminated metal part, the anode and the cathode being dipped in an electrolyte, so that a very thin surface layer of the metal part under the CRUD dissolves in the electrolyte. In the course of the electrolysis, metallic ions are eluted from the surface of the metal part, oxygen bubbles are generated and the electrolyte permiates into the CRUD, so that the CRUD is loosened from the metal part and dispersed in the electrolyte as suspended substances. Various radioactive substances dissolve and accumulate in the electrolyte during such electrolytic decontamination. Among them, metal oxides separated from the contaminated part and suspended in the electrolyte can be relatively easily taken out of the electrolyte in a recycling system by employing a solid-liquid separation method such as filtration of the electrolyte or separation by sedimentation.

On the other hand, radioactive substance eluted from the contaminated part and existing in the form of metallic ions in the electrolyte cannot be removed by the solid-liquid separation methods mentioned above and therefore they gradually accumulate in the electrolyte, thus increasing the radiation level of the electrolyte. If electrolytic decontamination is continued using an electrolyte in this state, workers are possibly exposed to the radiation and the service life of the electrolyte comes to an end because the electrolytic polishing efficiency is reduced as the concentration of metallic ions dissolved in the electrolyte is increased.

A dilute aqueous solution of a strong acid such as diluted surfuric acid may be used as an electrolyte for electrolytic polishing decontamination as described. This solution effects rapid polishing and it is easily disposed of after use. The surface polished using this solution is, however, rough and consequently easily contaminated again. Therefore, use of this solution is limited only to contaminated parts that are to be disposed of rather than reused. Of the high concentration acid solutions generally used for electrolytic polishing high concentration sulfuric acids yield a reduced glossy polished surface, but high concentration phosphoric acids and high concentration phosphoric acids-sulfuric acids yield a more glossy surface. Therefore, they are quite effective in preventing recontamination of equipment desired to be reused, though there has been a problem in disposal of the waste electrolyte. Specifically, various methods have been presented for isolating metallic ions accumulated in high concentration in the electrolyte during decontamination, although it has been considered difficult to isolate concentrated metallic ions dissolved in the electrolyte when a high concentration acid solution is used as the electrolyte.

One of the known isolation methods is to separate metallic ions by allowing them to deposit on a cathode capture electrode in an electrolytic cell provided with a partitioning diaphragm such as an unglazed plate or an ion exchange membrane. In this case, the reaction that generates hydrogen gas at the capture cathode electrodes takes place prior to the reaction for metal deposition on the capture electrode in the cathode chamber partitioned by the diaphragm, and therefore it is necessary to lower the hydrogen ion concentration to such an extent as to permit metal deposition. In an electrolyte of high concentration acid solution, however, acid is diffused into the cathode chamber due to large gradient of concentration between the anode and the cathode chambers partitioned by the diaphragm. As a result, it is not possible to lower the hydrogen ion concentration to such an extent as to permit metal deposition, and the diaphragm cannot have an expected effect.

Because of the above reasons, a high concentration acid solution used as a decontaminating electrolyte is conventionally solidified in plastic or cement for disposal, when the concentration of metallic ions dissolved in the electrolyte or the radiation level of the electrolyte increases to a certain value. Such disposal of the waste electrolyte presents another problem from the increasing quantity of waste which causes secondary contamination.

It is a primary object of this invention to present various methods of isolating metallic ions dissolved in an electrolyte during the process of electrolytic decontamination, in the state of the highest possible concentration, and of reproducing the electrolyte so as to minimize the volume of the secondary waste.

BRIEF SUMMARY OF THE INVENTION

In electrolytic decontamination of radioactively contaminated equipment or parts, various methods well known for general electrolytic polishing can be employed. In electrolytic decontamination, the volume of the secondary waste can be reduced by selecting a suitable electrolyte in accordance with the objects to be decontaminated.

The objects to be decontaminated are divided into two types: First, wastes resulting from dismantlement of radioactively contaminated equipment and parts, and second, equipment, vessels, pipes and tools that are to be reused.

The electrolyte used for decontamination of the first type may be an inorganic acid aqueous solution of relatively low concentration that is inexpensive and rapid in polishing. A suitable inorganic acid is sulfuric acid that does not generate harmful gases in the process of electrolysis. The concentration of the sulfuric acid should be high to achieve polishing efficiency. About 5 Vol. % is the most suitable for uniform polishing and disposal of waste electrolyte. An electrolyte of this concentration is effective in macroscopic polishing but not in microscopic polishing (mirror finish), however. Therefore, an electrolyte for decontamination of the second type that requires microscopic polishing must be a high concentration acid solution, preferably 70% or higher phosphoric acid content. According to this invention, the electrolyte is reproduced by an electrodeposition process in diaphragm electrolysis.

BRIEF DESCRIPTION OF THE DRAWINGS

The invention will be better understood from the following detailed description including some examples, in conjunction with the accompanying figures of the drawings, wherein.

DETAILED DESCRIPTION OF THE DRAWINGS

Figure 1:
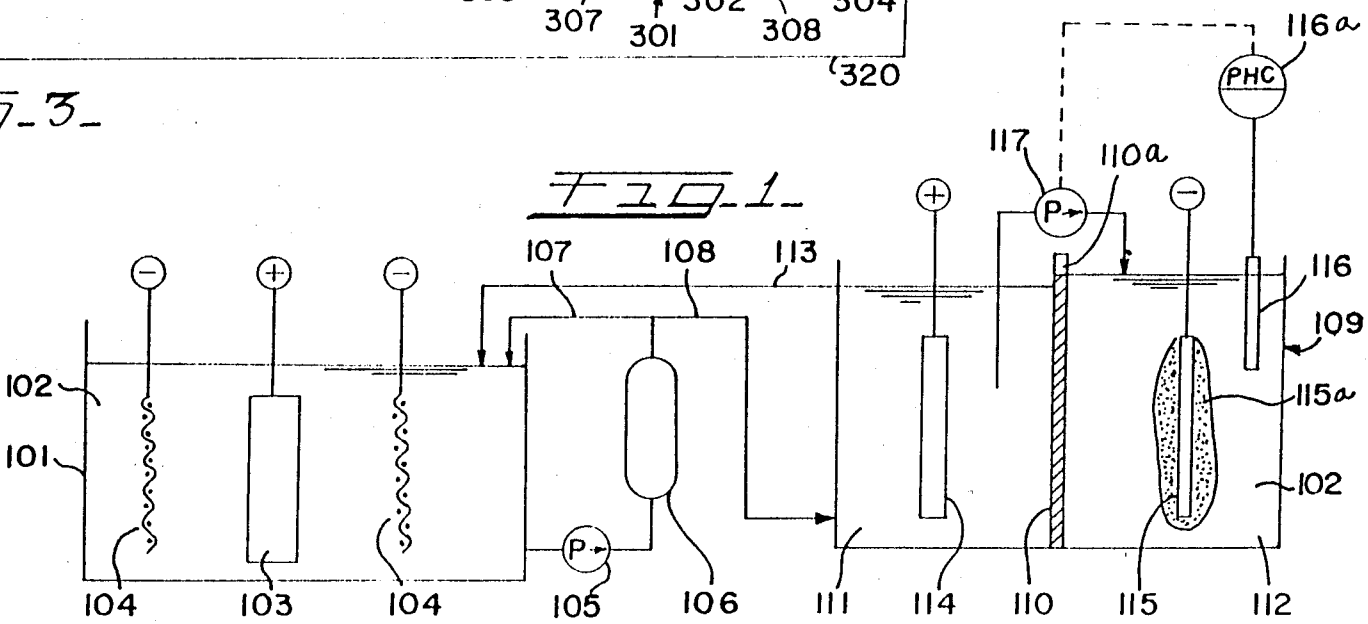
FIG. 1 is a system according the the invention for reproducing an electrolyte using inorganic acid solution of relatively low concentration.

FIG. 1 shows an example of a system in accordance with this invention for reproducing an electrolyte from an electrolytic decontamination using inorganic acid aqueous solution of a relatively low concentration. Unlike a system for the electrolytic decontamination using a high concentration phosphoric acid-sulfuric acid electrolyte that is generally used for electrolytic polishing, in the electrolytic decontamination using an inorganic acid aqueous solution of relatively low concentration, metallic ions dissolved in the electrolyte are easily deposited on a capture electrode in the form of solid metal, and therefore are isolated in the state of the highest possible concentration. This is advantageous in that waste electrolyte, the secondary waste to be disposed of after isolating metallic ions, is in a small amount.

In this example, however, the hydrogen ion concentration is still high during the process of electrolytic decontamination. The reaction which generates hydrogen gas takes place prior to the reaction for metallic deposition on the capture electrode, but when an electrolyte is diluted to the hydrogen ion concentration to permit metallic deposition, polishing efficiency substantially reduces, making electrolytic decontamination impossible. Accordingly, when metallic ions in the electrolyte have increased to a certain level, it is necessary to transfer the electrolyte to another cell where metallic ions are isolated by deposition and as the pH is adjusted by injecting an alkali. Another method . available for isolating metallic ions by deposition is to install an unglazed plate or a similar porous electrolytic diaphragm between the anode and cathode in the electrolytic cell so as to effect a diaphragm electrolysis.

In the deposition and isolation of metallic ions by diaphragm electrolysis, the hydrogen ion concentration in the electrolyte drops due to the generation of hydrogen gas in the cathode chamber, and metallic ions in the electrolyte deposit on the capture electrode. Therefore, the electrolYtic cell is partitioned by an electrolytic diaphragm, and the capture electrode is provided in the cathode chamber. Otherwise, a capture electrode surrounded by an electrolytic diaphragm formed by a unglazed cylinder is installed in the electrolytic cell. When DC current is passed between the contaminated object, which is the anode, and the capture cathode electrode, metallic ions dissolved in the electrolyte can be isolated by deposition simultaneously with electrolytic decontamination of the cohtaminated object. This helps to prevent the concentration of the metallic ions dissolved in the electrolyte from increasing, thus extending the service life of the electrolyte.

In such a case, however, the reaction for the elusion of metallic ions takes place prior to the reaction for generating oxygen gas on the surface of the object to be decontaminated in the anode chamber. As a result, the number of hydrogen ions as cations decreases so that acid ions are kept electrically neutral with respect to metallic ions. Therefore, the acid concentration drops, deteriorating the electrolyte. Meanwhile, hydrogen gas continues to be generated in the cathode chamber. When the hydrogen ion concentration reduces to the extent that metal hydroxide begins to be produced, the metallic ions cannot be isolated by deposition. This means that the useful or service life of the electrolyte is at an end.

In the system shown in FIG. 1, in addition to the decontaminating electrolytic cell, a metallic ion isolating cell, that is divided into an anode chamber and a cathode chamber, is installed for circulation of the electrolyte in the anode chamber during the process of decontamination. In the metallic ion isolating cell, a DC current is allowed to flow between the insoluble electrode in the anode chamber and the capture electrode in the cathode chamber as the pH of the electrolyte in the cathode chamber is controlled by pouring the electrolyte from the anode chamber into the cathode chamber. Thus, the electrolyte is reproduced at the same time with isolation by deposition of metallic ions dissolved in the electrolyte and returned to the decontaminating electrolytic cell, so that electrolytic decontamination of contaminated objects and isolation by deposition of dissolved metallic ions can be continued semi-permanently. According to this method, metallic ions dissolved in the electrolyte are isolated by deposition while the pH of the electrolyte is controlled by injecting electrolyte having a high hydrogen ion concentration from the anode chamber into the cathode chamber. Therefore, deterioration of the deposition process due to an excessive rise in the pH value does not occur. Acid ions set free because of the deposition of metallic ions move through the electrolytic diaphragm into the anode chamber where they bond with hydrogen ions generated as oxygen gas is produced, on the insoluble electrode so that they are reproduced as acid. Thus, deterioration of the electrolyte is prevented in this example of the invention.

Referring now to FIG. 1, a contaminated metal part or object 103 is connected to a positive DC potential and acts as an anode. The part 103 is submersed or dipped in an electrolyte 102 of a decontamination electrolytic cell 101, and a plurality of cathodes 104 are installed around the anode. A negative DC potential is connected to the cathodes 104 and a DC current is passed between the electrodes in order to perform an electrolytic decontamination of the surface of the contaminated object 103 as previously described.

The electrolyte 102 is fed by a pump 105 from the electrolytic cell 101 to a filter 106 where suspended substances are removed, and returned through a pipe 107 into the cell 101, thus also agitating the electrolyte in the cell. Part of the circulating electrolyte is sent through a branch pipe 108 into the lower level of a metallic ion isolating cell 109 which is divided into an anode chamber 111 and a cathode chamber 112 by an electrolytic diaphragm 110. The circulating electrolyte from the branch pipe 108 enters the anode chamber 111 and flows back into the decontamination electrolytic cell 101 through an overflow pipe 113 connected to an upper level of the cell 109.

An insoluble electrode 114 of, for example, platinum-plated titanium, and a capture electrode 115 of, for example, steel sheet are installed in the anode chamber 111 and cathode chamber 112, respectively. Positive and negative DC potentials are connected to the electrodes 114 and 115, and DC current is passed through the electrolyte of the cell and the electrolytic diaphragm 110 between the electrodes. The cathode chamber 112 is filled with the electrolyte 102 so that metallic ions dissolved in the electrolyte are deposited on the capture electrode 115. This causes a build-up 115*a* on the electrode 115. In the initial phase of current flow at the beginning of operation, the hydrogen ion concentration of the electrolyte in the cathode chamber 112 is high and a large volume of hydrogen gas is generated at the capture electrode 115. Therefore, the metallic ions do not deposit on the electrode 115. The amount of hydrogen gas being generated is decreased with an increase in pH value of the electrolyte, and then the metallic ions start to deposit on the electrode. The solution in the chamber 112 is agitated by an upward flow of the hydrogen gas generated on the capture electrode 115, and the solution is maintained at substantially pH 2.

When the DC current is allowed to flow for a long time, however, the pH value of the electrolyte further increases. When it exceeds approximately pH 2, metal hydroxide begins to be generated in the cathode chamber 112, thereby slowing the deposition of metal. To avoid this, a pH meter 116 is installed in the cathode chamber 112. When pH 2 level is exceeded, more electrolyte having a lower pH value from the anode chamber 111 is fed by a pump 117 into the cathode chamber 112 to prevent an excessive rise in pH value. There is a return flow from the cathode chamber 112 to the anode chamber 111 through an overflow notch 110*a* formed in the upper edge of the diaphragm 110. A similar return flow arrangement may be provided in the other systems disclosed herein when necessary. A control 116*a* is connected to the pump 117 and to the pH meter 116 and it responds to the meter output such as to turn on the pump 117 when the pH level becomes excessive.

As a specific example of the above apparatus, the cells were filled with a 5% sulfuric acid aqueous solution as the electrolyte 102. 10A/dm$^2$ DC current was allowed to flow for 15 minutes and stopped for 45 minutes to perform continuous electrolytic polishing of an SUS 304 plate as a contaminated object 103 in the decontamination electrolytic cell 101. In the metallic ion isolating cell 9, 5A/dm$^2$ DC current was allowed to flow continuously, while automatically injecting electrolyte, using the meter 116 and the control 116*a*, from the anode chamber 111 into the cathode chamber 112, so that hydrogen ion concentration of the electrolyte in the cathode chamber did not exceed pH 2. Thus, the apparatus was operated continuously for two weeks to decontaminate the SUS 304 plate by electrolytic polishing and to perform isolation by deposition of metallic ions separated from the SUS 304 plate and dissolved into the electrolyte. The result was that the metallic ions deposited on the capture electrode 115 in a stable manner and therefore iron ion concentration in the electrolyte never exceeded 25.2 g/l in the electrolytic cell 101. Sulfuric acid ions set free due to deposition of metallic ions in the cathode chamber 112 moved through the electrolytic diaphragm 110 into the anode chamber 111 and bonded with hydrogen ions generated on the insoluble electrode 114, thus being reproduced as metal-free sulfuric acid. Therefore, electric conductivity of the electrolyte did not decrease.

On the other hand, when the apparatus was operated without injecting electrolyte from the anode chamber 111 into the cathode chamber 112, the hydrogen ion concentration of the electrolyte in the cathode chamber 112 increased to pH 4 in about 18 hours and a large volume of metal hydroxide was generated. As a result, electrical conductivity of the electrolyte substantially reduced, thereby slowing the decontamination operation.

In electrolytic decontamination with a dilute inorganic acid aqueous solution, polishing efficiency is not so much decreased as is the case with a high concentration phosphoric acid electrolyte, and disposal of spent electrolyte is relatively easy. The dilute inorganic acid aqueous solution electrolyte yields a smooth finished surface but not a mirror finished glossy surface which would be obtained with a high concentration phosphoric acid electrolyte. For example, if 10A/dm$^2$ DC current is allowed to flow for 30 minutes to produce electrolytic polishing of the surface of a SUS 304 plate in phosphoric acid electrolyte containing 50% phosphoric acid and 25 % sulfuric acid, a surface with 0.45 μm surface roughness and 418 gloss is obtained. On the other hand, if same experimentation is performed in a dilute aqueous solution electrolyte containing 5% sulfuric acid, a surface with 0.27 μm surface roughness and 65 gloss is obtained. In short, high concentration phosphoric acid electrolyte can yield a glossy surface but it is difficult to dispose of, whereas a dilute aqueous solution electrolyte is relatively easy to dispose of but does not yield as glossy a surface.

One of the convenient methods making use of the advantages of these two types of electrolyte is first to perform electrolytic decontamination in a dilute electrolyte in the first stage, and then to perform electrolytic polishing in a high concentration phosphoric acid solution electrolyte in the second stage so as to obtain a glossy surface. The contamination of high concentration electrolyte can be minimized by this method.

Figure 2:
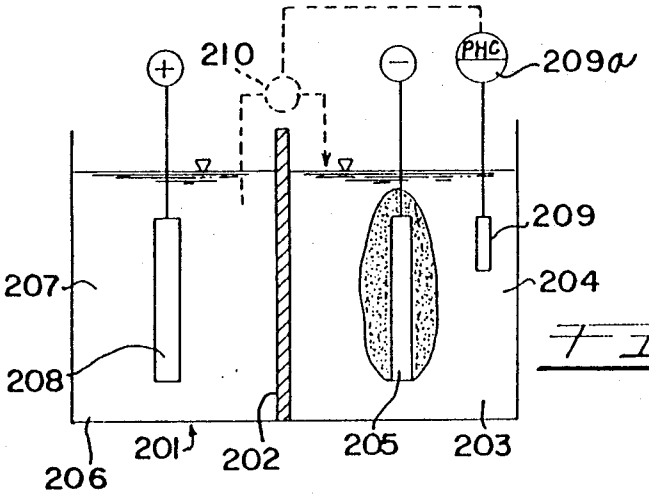
FIG. 2 is another system for reproducing an electrolyte of high concentration acid.
Figure 5A:
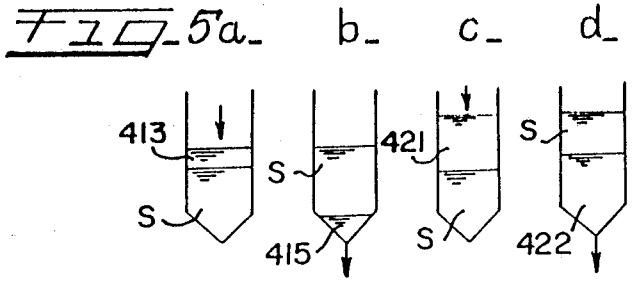

FIG. 2 shows an example of reproducing or regenerating process of a high concentration acid decontamination electrolyte, by electrodeposition. According to this example, an electrolytic cell is divided by a diaphragm into an anode chamber and a cathode chamber. The cathode chamber is provided with a capture electrode and filled with electrolyte whose service life is spent.

The anode chamber is provided with an anode formed by an insoluble electrode and filled with aqueous solution whose pH is adjusted to about 2 by adding acid of the same components as the electrolyte. In this apparatus, DC current is allowed to flow through the diaphragm between the anode (the insoluble electrode) and the cathode (the capture electrode) so as to isolate metallic ions dissolved in the spent electrolyte by deposition on the cathode and at the same time to recover the electrolyte as strong acid solution of the initial concentration.

In this method, in order to separate metallic ions dissolved in the spent electrolyte in the cathode chamber, it is required to remove hydrogen ions in the form of hydrogen gas from free acid that does not bond with metallic ions so as to lower the hydrogen ion concentration. Meanwhile, in order to reproduce acid solution electrolyte of the same volume and the same concentration with that decomposed in the cathode chamber, it is necessary to transfer anions separated in the cathode chamber into the anode chamber through the diaphragm so that they bond with hydrogen ions generated on the insoluble electrode or anode. In principle, the anode chamber should be filled with electrolyte of the same volume as that in the cathode chamber and should not contain acid. Such neutral electrolyte without acid content would, however, provide poor electric conductivity and make diaphragm electrolysis difficult. It is necessary, therefore, to employ a solution having such an acid content as to assure electric conductivity but not to affect the acid concentration of the reproduced electrolyte. In this sense, it s most desirable to use a solution of about pH 2 and with the same acid component as the electrolyte in the first batch so as to assure good electric conductivity, and to utilize the solution processed in the cathode chamber as anolyte for the subsequent batch.

According to this batch system method, during the earlier phase of current flow, hydrogen ions disperse in the form of hydrogen gas from the acid solution in the cathode chamber so that anions are separated, while hydrogen ions are produced as oxygen gas is generated on the insoluble electrode in the anode chamber. The anions separated in the cathode chamber move into the anode chamber where they bond with hydrogen ions so that the acid is reproduced. In the course of this reaction cycle, the hydrogen ion concentration of the electrolyte in the cathode chamber drops to pH 2 when the dissolved metallic ions begin to deposit on the capture electrode. While metallic ions are depositing on the capture electrode, separated anions continue to move into the anode chamber so as to be reproduced as acid. Ultimately, therefore, a high concentration acid solution with dissolved oxygen ion removed is reproduced in the same amount as the initial electrolyte in the anode chamber. This reproduced acid solution is reusable as an electrolyte for electrolytic decontamination. Meanwhile, a solution of about pH 2 containing substantially no dissolved metallic ion is left in the cathode chamber, allowing metallic ions to deposit on the capture electrode. The solution in the cathode chamber may be moved into the anode chamber as pH adjusted anolyte for the subsequent batch. Through the repetition of this batch operation, dissolved metallic ions are separated in the form of solid metal and the electrolyte is reproduced without producing waste liquid.

This method will be further described in detail, with reference to FIG. 2. An electrodeposition reproducing cell 201 is divided by a diaphragm 202 into a cathode chamber 203 and an anode chamber 206. The cathode chamber 203 contains a capture electrode 205 made of steel sheet and is filled with spent electrolyte 204, i.e. radioactive metallic ion-containing a high concentration acid electrolyte whose service life is over. The anode chamber 206 having substantially the same capacity as the cathode chamber contains an insoluble electrode 208 made, for example, of platinum-plated titanium net and is filled with an anolyte 207 having a hydrogen ion concentration adjusted to about pH 2 by an acid solution of the same components as the electrolyte so as to have good electric conductivity. Then, DC current is passed between the insoluble electrode 208 (the anode) and the capture electrode 205 (the cathode) so that dissolved metallic ions are deposited on the capture electrode 205, and so that electrolyte is reproduced or regenerated in the anode chamber 206. In the initial phase of the current flow, the hydrogen ion concentration of the electrolyte in the cathode chamber 203 is so high that a large volume of hydrogen gas is generated on the capture electrode 205, and therefore, metallic ions are not deposited on the capture electrode. When the hydrogen ion concentration of the electrolyte 204 decreases to about pH 2, however, the hydrogen gas is generated in a decreased amount and metallic ions begin to deposit on the capture electrode. Anions produced in the cathod• chamber 203 then move through the diaphragm 202 into the anode chamber 206 where they bond with hydrogen ions produced by oxygen generation on the insoluble electrode 208 in the anode chamber 206 so as to be reproduced as an electrolyte. The current supply is continued until the desired result is obtained.

In case the pH of the spent electrolyte in the cathode chamber 203 rises excessively in the course of the current flow, a pH meter 209 may be installed in the cathode chamber 203 and connected to a control 209*a* so that when an excessive rise in the pH is detected by the pH meter 209, a pump 210, actuated by the control 209*a*, is actuated to feed electrolyte reproduced in the anode chamber 206 into the cathode chamber 203, thereby controlling the hydrogen ion concentration of the spent electrolyte to about pH 2 so as to assure efficient electrodeposition.

The following are specific examples of the foregoing system:

EXAMPLE I

The system was operated with spent electrolyte resulting from electrolytic decontamination of SUS 304 stainless steel in an electrolyte containing 75 wt% phosphoric acid. 62.5 g/l of iron ions, 9.75 g/l of chromium ions, 7.75 g/l of nickel ions and 0.21 g/l of cobalt ions were dissolved in the spent electrolyte.

The cathode chamber 203 in FIG. 2 was filled with the spent electrolyte of the above composition and the anode chamber 206 was filled with an anolyte whose hydrogen ion concentration was adjusted to pH 2. Diaphragm electrolysis was conducted by supplying 10A/dm$^2$ DC current until the total current supply reached 3,500 AH/l. As a result, 0.045 g/l of iron ions, 0.052 g/l of chromium ions, 0.067 g/l of nickel ions and 0.002 g/l of cobalt ions were left in the spent electrolyte in the cathode chamber 203. In the anode chamber 206, the electrolyte was recovered as high concentration phosphoric acid solution with 75 wt% phosphoric acid content and containing 1250 g/l of phosphoric acid ions. Namely, electrolyte of substantially the same composition with the original electrolyte was reproduced except that about 20% metallic ions leaked through the diaphragm 202 into the reproduced electrolyte due to the diffusion of concentration.

EXAMPLE II

Similar to the above experiment, diaphragm electrolysis was conducted according to this example in a high concentration acid solution electrolyte composed of 70 Vol. % of 85% phosphoric acid and 30 Vol. % of 98% sulfuric acid. The spent electrolyte resulted from electrolytic decontamination in the above electrolyte containing irons ions, chromium ions, nickel ions and cobalt ions in the same amount as for Example I. The result obtained was the same as that in Example I. The electrolyte reproduced in the anode chamber 206 contained phosphoric acid and sulfuric acid in the same mixing ratio as for the original electrolyte.

Figure 3:
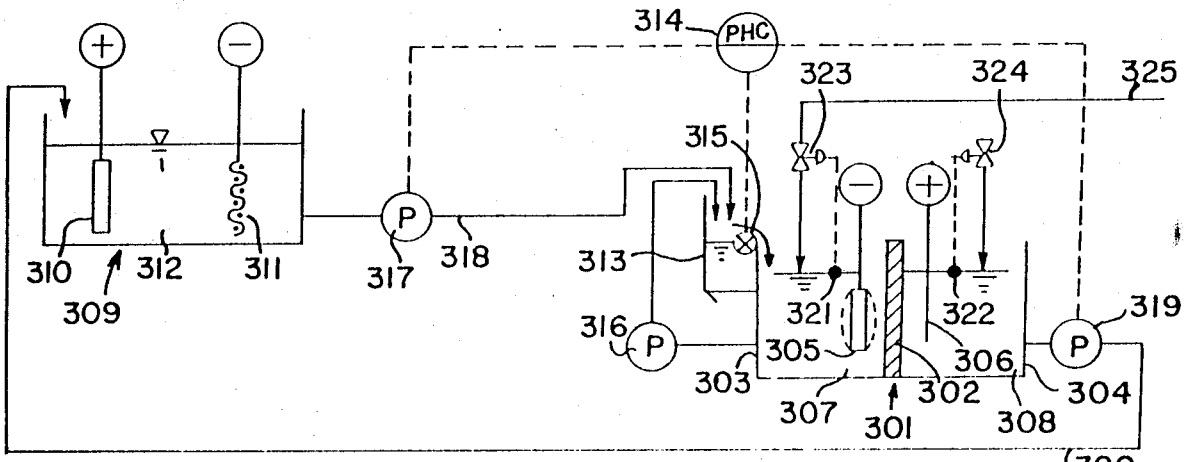
FIG. 3 is another system using a high concentration acid solution.

FIG. 3 shows another system in accordance with the present invention in which electrolytic decontamination is performed in a high concentration acid solution electrolyte. According to this example, decontaminating electrolyte is successively reproduced by electrodeposition.

In this example, an electrodeposition reproducing cell is divided by a diaphragm into an anode chamber and a cathode chamber. Electrolyte from an electrolytic decontamination cell is injected into the cathode chamber of the electrodeposition reproducing cell by using a pH controller so that hydrogen ion concentration in the cathode chamber is maintained at pH 2 at all times. To assure continuous injection, the electrodeposition reproducing cell and the electrolytic decontaminating cell are connected with each other. When DC current is allowed to flow through the diaphragm between the capture electrode in the cathode chamber and the insoluble electrode in the anode chamber, the pH value of the electrolyte in the cathode chamber increases as hydrogen ions are discharged as hydrogen gas from the electrolyte. According to this example, injection of the electrolyte from the electrolytic decontaminating cell into the cathode chamber starts when the pH value exceeds approximately 2, and stops when the pH value drops to approximately 2 or below. At the same time, to maintain a balance, a high concentration acid solution reproduced in the anode chamber of the electrodeposition reproduction cell is fed into the electrolytic decontamination cell in the same amount with the above injection for pH adjustment. This operation is automatically repeated under the control of a pH controller.

In the electrodeposition reproducing cell of this example, radioactive metallic ions are separated without delay from the electrolyte with the pH value maintained at 2 and deposited on the capture electrode in the cathode chamber and hydrogen gas is generated. Anions separated by generation of hydrogen gas move through the diaphragm into the anode chamber where they bond with hydrogen ions generated on the insoluble electrode or anode so as to be reproduced as a high concentration acid solution. To initiate the electrodeposition reproducing process, therefore, it is only necessary to fill the cathode chamber with ordinary water and the anode chamber with the high concentration acid solution of the same concentration with the electrolyte used for the electrolytic decontamination process, only once at the beginning of operation. Electrodeposition reproduction is automatically continued because of a circulation of the solution. Moreover, the cathode and the anode chambers are automatically charged with water by means of level gauges each provided in the chambers so as to always maintain the levels constant. The makeup water is required only in the amount sufficient to compensate for the loss due to generation of hydrogen and oxygen as well as evaporation of water during operation.

As mentioned above, this example has made possible a continuous system integrating electrolytic decontamination process and electrodeposition reproducing process. Specifi. cally, equipment or a part that is radioactive on its surface is decontaminated using a high concentration acid solution as electrolyte while the electrolyte is continuously fed to the electrodeposition reproduction process under a certain condition. In the electrodeposition reproducing cell, radioactive metallic ions separated from the electrolyte are allowed to deposit on the capture electrode in the form of radioactive metal which is easily disposed of. At the same time, the reproduced high concentration acid solution is fed back into the electrolytic decontamination cell in the same amount as the electrolyte fed to the electrodeposition reproducing cell for reproduction. According to this integrated continuous system, the radiation dose of the electrolyte is always maintained at a low level and metallic ion leakage to the reproduced electrolyte is minimized in the electrodeposition reproducing process. Besides, the radiation dose as well as the metallic ion content in the electrolyte are also maintained at low levels due to the renewal of the electrolyte in the electrolytic decontamination process. Moreover, compared with apparatus of a batch type of system, the apparatus according to this example requires a smaller number of devices and therefore is simpler in operation.

One of the remarkable features of this example is that the hydrogen ion concentration of the electrolyte in the electrodeposition reproducing cell is maintained at pH 2 from the beginning of the operation. In the conventional electrodeposition reproducing process of batch system, it is necessary to operate the apparatus for a time to allow the hydrogen generating reaction to occur, before the pH value in the cathode chamber reaches 2 at which time the metallic ions begin to deposit on the capture electrode, whereas in this example, the apparatus is operated with the cathode chamber being filled with a solution of pH 2 and the anode chamber filled with high concentration acid solution from the beginning.

The foregoing example is more specifically described with reference to FIG. 3. The electrodeposition reproducing cell 301 used for the electrodeposition reproducing process according to this example is divided by a diaphragm 302 into a cathode chamber 303 and an anode chamber 304. The cathode chamber 303 contains a capture electrode 305 made, for example, of an iron sheet and is filled with ordinary water 307 at the beginning. The anode chamber 304 contains an insoluble electrode 306 made, for example, of platinum-plated titanium net and is filled with a high concentration acid solution 308 having the same components and concentration as the electrolyte used for electrolytic decontamination process at the beginning. DC current is passed between the electrodes 305 and 306.

In the electrolytic decontamination cell 309 used for the electrolytic decontamination process, equipment or a part bearing radioactivity on the surface is provided as an anode 310 and an insoluble electrode of the same type as the electrode 306 is provided as a cathode 311.

The cell is filled with a high concentration acid solution used as electrolyte 312. DC current is passed between the electrodes 310 and 311 to perform electrolytic polishing so that at least part of the radioactive substance is removed from the anode surface and suspended in the electrolyte and the other part thereof is dissolved as radioactive metallic ions in the electrolyte, thus completing the decontamination process.

According to this example, these two processes are operated in cooperation with each other. Namely, a pH detecting auxiliary bath 313 is installed on the upper part of the cathode chamber 303 of the electrodeposition reproducing cell 301. The auxiliary bath 313 is provided with a pH meter sensor or electrode 315 that is connected to a pH controller 314 and set at pH 2. Water 307 in the cathode chamber 303 is circulated by means of a circulation pump 316 through the auxiliary bath 313 for detection of pH value and then back to the chamber 303.

An injection pipe 318 equipped with an injection pump 317 leads from the cell 309 to the auxiliary bath 313 (or the cathode chamber 303), the injection pump 317 being connected to be operated by the pH controller 314 so as to continuously inject electrolyte 312 from the electrolytic decontaminating cell 309 into the cathode chamber 303. Further, a suction pipe 320 equipped with a suction pump 319 leads from the anode chamber to the electrolytic decontaminating cell 309, the suction pump 309 being connected to be operated by the pH controller 314. Unlike a batch type system, the capacity of the anode chamber 304 with the present circulating system may be moderately small.

As mentioned earlier, the cathode chamber 303 and the anode chamber 304 are filled with ordinary water and a high concentration acid solution, respectively, at the beginning of operation. The circulation pump 316 is then operated to circulate water 307 in the cathode chamber 303 and the bath 313. Since the pH value of the water 307 in the cathode chamber is higher than 2 at this stage, the pH controller 314 actuates the interlocking injection pump 317, resulting in the electrolyte 312 in the electrolytic decontaminating process being injected into the cathode chamber 303 (or the auxiliary bath 313). Simultaneously, the suction pump 319 is also actuated by the pH controller 314 whereby the solution 308 in the anode chamber is suctioned off and fed back into the electrolytic decontaminating cell 309 in the same amount as the electrolyte being injected from the electrolytic decontaminating cell 309 into the cathode chamber 303.

This initial operation is continued for a certain period before DC current is allowed to flow between the electrodes 306 and 305. When the pH value in the cathode chamber 303 drops to 2, the injection pump 317 and the suction pump 319 are stopped by the functioning of the pH controller 314. When electrolysis is continued by supplying DC current to the electrodes 305 and 306 in the electrodeposition reproducing cell 301 while the pH value in the cathode chamber is maintained at 2, radioactive metallic ions dissolved in the solution 307 in the cathode chamber 303 deposit and accumulate in the form of metal deposits on the capture electrode 305. Then, anions move through the diaphragm 302 into the anode chamber 304 where the high concentration acid solution is reproduced. If, in the course of the electrolysis, the pH value in the cathode chamber 303 exceeds 2, the injection pump 317 and the suction pump 319 are actuated again so as to adjust pH value in the cathode chamber 303 at 2. The above operation is automatically repeated so that electrolyte is reproduced by electrodeposition substantially continuously and constantly.

In the operation of the above process, water evaporates due to exothermic reaction in the cathode chamber 303 and reduces due to decomposition of water in the anode chamber 304 during the electrolytic operation in the electrodeposition reproducing cell 301. It is necessary to compensate for such water loss so as to ensure continuous and steady operation. To this purpose, solenoidoperated valves 323 and 324 are connected to the respective chambers and are controlled by level gauges 321 and 322 provided in the chambers 303 and 304. The valves 323 and 324 are connected in waterlines 325 and water is automatically supplied to maintain a constant level in the chambers.

Specific examples illustrating the operation of the process shown in FIG. 3 are given below:

EXAMPLE III (A) Process of Electrolytic Decontamination

Radioactively contaminated SUS 304 stainless steel was used as an anode 310 to be decontaminated, and 75 wt % of phosphoric acid solution was used as an electrolyte to perform the electrolytic decontamination. 38 g/l of iron ions, 8.8 g/l of chromium ions, 6.8 g/l of nickel ions and 0.092 g/l of cobalt ions were dissolved in the spent electrolyte.

(B) Process of Electrodeposition Reproduction

The cathode chamber 303 of the electrodeposition reproducing cell 301 was initially filled with ordinary water and the anode chamber 304 was filled with 75 wt % phosphoric acid solution devoid of metallic ions at the beginning. After injecting said spent electrolyte into the cathode chamber 303 by means of the injection pump 317, 8A/dm$^2$ current was supplied to start the electrolytic operation of the cell 301 so as to check the change with time in the concentration of residual metallic ions in the solution 307 in the cathode chamber and the solution 308 in the anode chamber. The result was that the solution 307 in the cathode chamber contained 0.005 to 0.060 g/l of iron ions, 0.003 to 0.01 g/l of chromium ions, 0.001 to 0.005 g/l of nickel ions and 0.0001 to 0.0003 g/l of cobalt ions and that the solution 308 in the anode chamber contained 0.01 to 0.02 g/l of iron ions, 0.006 to 0.007 g/l of chromium ions, 0.004 to 0.005 g/l of nickel ions and 0.0001 to 0.0002 g/l of cobalt ions due to leakage.

As is obvious from these figures, the level of metallic ions was maintained very low both in the cathode chamber 303 and in the anode chamber 304. Moreover, current efficiency was stable around 10% during the above operation.

EXAMPLE IV

During operation as in Example III above, an electrolyte of a different composition from that given in Example III was temporarily injected into the cathode chamber 303 under the same condition as above. Namely, 4.84 g/l of iron ions, 1.47 g/l of chromium ions, 0.34 g/l of nickel ions and 0.0126 g/l of cobalt ions were contained in the electrolyte. These values are all smaller than those for the electrolyte above. As a result of examination of the change with time in the metallic ion concentration in the solution 307 in the cathode chamber as well as in the current availability, it was revealed that both the cathode and anode chambers contained metallic ions in smaller amounts than in Example I, as shown by the specific figures below. Current efficiency was not changed and was about 10%.

Residual metallic ions in the solution 307 in the cathode chamber: iron ion 0.0032 g/l, chromium ion 0.00096 g/l, nickel ion 0.0014 g/l, cobalt ion 0.0003 g/l. Residual metallic ions in the solution 308 in the anode chamber: iron ion 0.016 g/l, chromium ion 0.0025 g/l, nickel ion 0.004 g/l, cobalt ion 0.002 g/l.

As shown by the above figures, metallic ions were contained in larger amount in the solution 308 in the anode chamber than in the solution 307 in the cathode chamber, presumably because the electrolyte used in Example III remained in the anode chamber.

Utilizing the foregoing process, it is possible to realize a novel and useful embodiment of the invention. Conventionally, a radioactively contaminated electrolyte remains on the surface of the object after it has been electrolytically decontaminated, and therefore it is necessary to rinse the object in water to remove electrolyte. Radioactive metallic ions then enter the rinsing water, causing secondary contamination and a troublesome secondary treatment is therefore required.

According to a novel embodiment of this invention, however, the object is rinsed by spraying it with the solution from the electrodeposition reproducing cell or, preferably, the solution 307 in the cathode chamber that contains metallic ions having a lower level of radioactivity, or it is dipped in the solution 307 in the cathode chamber for a preliminary rinsing and then it is washed in water. The solution used for spray-rinsing is returned to the cathode chamber 303. The radioactively contaminated electrolyte thus entering the solution 307 in the cathode chamber presents no problem because it is part of the electrolyte to be injected for electrodeposition reproduction. In addition, according to this method, the level of radioactivity of the metallic ions dissolved in the scondary rinsing water is much lower than that encountered by conventional methods and is within the safety limit.

The systems shown in FIGS. 4 to 7 are modifications of the systems shown in FIGS. 2 and 3 dealing with the process of electrodeposition reproduction of high concentration phosphoric acid decontaminating electrolyte, that is effective in preventing recontamination. The function of these systems is to improve processing capacity or reduce the time required for electrodeposition reproduction. In these embodiments, phosphoric acid is extracted, by a solvent, from the high concentration phosphoric acid decontaminating electrolyte used for an electrolytic decontamination process prior to feeding the electrolyte into the electrodeposition reproducing cell. The resultant solution after extraction (or electrolyte whose phosphoric acid content is decreased) is fed into the cathode chamber of the electrodeposition reproducing cell. Further, phosphoric acid is inversely extracted, by water, from the above solvent after extraction, and the resultant inverse extractive solution (or phosphoric acid aqueous solution containing substantially no metallic ion) is fed into the anode chamber of the electrodeposition reproducing cell. Thus, metallic ions in the solution is captured by electrodeposition in the cathode chamber, and the phosphoric acid concentration in the solution is increased to that of the initial electrolyte in the anode chamber so it may be reused as a decontaminating electrolyte.

The solvent for liquid-liquid extraction of phosphoric acid from phosphoric acid aqueous solution may be taken from the group comprising isopropyl ether, ethylene menomethyl ether, normal butyl alcohol, isoamyl alcohol, methyl isobutyl ketone or butyl acetate. Since these organic solvents evaporate due to the heat of the decontaminating electrolyte and are inflammable, they are not suitable as a phosphorus extracting agent to be used in the process of electrodeposition reproduction. Among various phosphorus extracting agents studied, water-insoluble and noncombustible tributyl phosphate (TBP) is found to be most effective as a phosphorus extracting agent to be used in the process of electrodeposition reproduction of decontaminating electrolyte.

Tributyl phosphate, known as a metal extracting agent, is usually used for extracting uranium from nitric acid. It is effective in extracting phosphoric acid but hardly extracts iron, nickel, chromium, cobalt or their metallic ions in a decontaminating electrolyte. By inverse extraction in water, phosphoric acid and metallic ions are almost completely extracted from this metal extracting agent. Besides, it can be used repeatedly without recharging because of its high boiling point and small evaporation loss.

More specific details of the process for electrodeposition reproduction of decontaminating electrolyte based on extraction and inverse extraction of phosphoric acid by use of a solvent will be described in connection with FIGS. 4 to 7.

Figure 4:
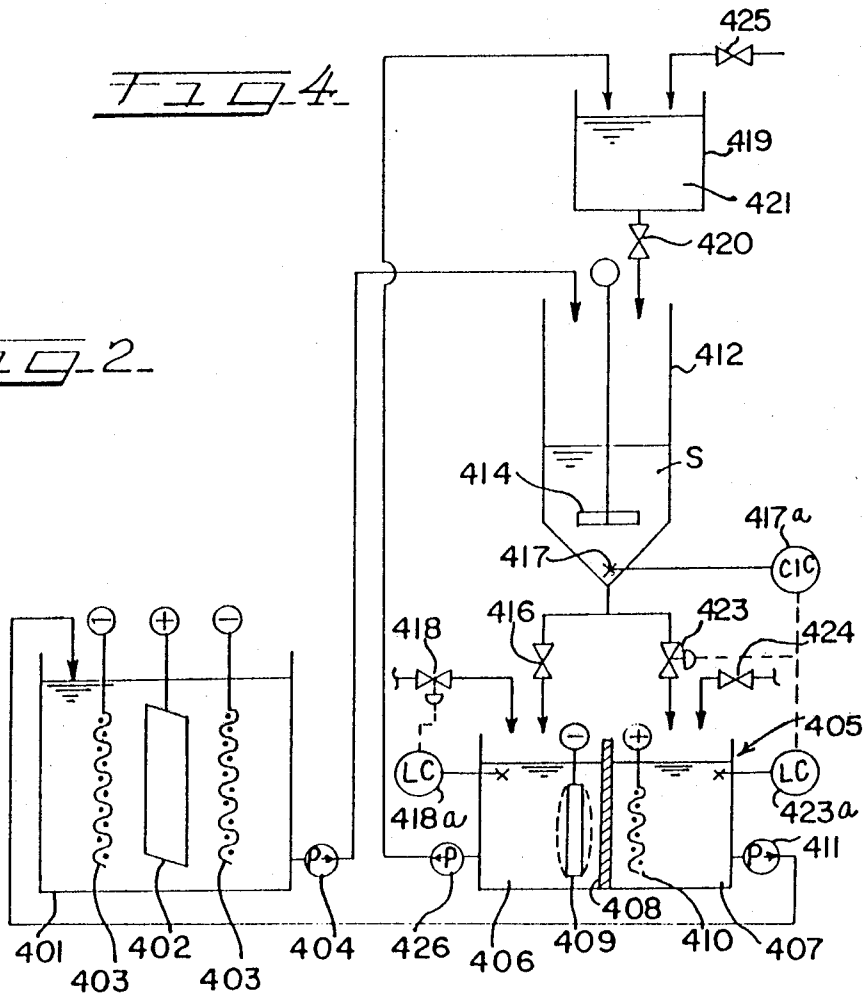
FIGS. 4 to 7 are modifications of the systems shown in FIGS. 2 and 3.

Referring specifically to FIG. 4 which shows an example of electrodeposition reproduction process, a high concentration acid of phosphoric acid series is used as an electrolyte in the process of electrolytic decontamination. An object 402 which is radioactively contaminated on its surface is set in the electrolyte in an electrolytic decontamination cell 401 and connected to the anode of a DC source such as an AC-DC rectifier (not shown). DC current is passed between the object and cathodes 403 in the electrolyte so as to decontaminate the surface of the contaminated object 402. The decontaminating electrolyte containing radioactive metallic ions separated from the surface of the object 402 is suctioned off by a pump 404 into the extractive separating bath 412 where the electrolyte is separated into two solutions: one solution is an electrolyte with less phosphoric acid content obtained by extraction of phosphoric acid by a solvent and the other is a phosphoric acid aqueous solution substantially free from metallic ions obtained by inverse extraction of phosphoric acid by water. The above electrolyte and phosphoric acid aqueous solution thus obtained are fed into the cathode chamber 406 and the anode chamber 407, respectively, of the electrodeposition reproducing cell 405. Then, DC current is passed through a diaphragm 408 between the capture electrode 409 in the cathode chamber 406 and an insoluble electrode 410 in the anode chamber 407 so as to effect electrodeposition reproduction of the decontaminating electrolyte. The solution in the anode chamber 407 whose phosphoric acid content is increased relative to that of the initial electrolyte is then fed back into the electrolytic decontaminating cell 401 by means of a pump 411.

The extractive separating bath 412 where extraction and inverse extraction of phosphoric acid are performed is filled with a solvent (S) to about half level or volume. Operation of the extraction and the inverse extraction is described in the following, with reference to FIGS. 5*a* to 5*d*.

A decontaminating electrolyte 413 (FIG. 5*a*) of the same volume as the capacity of the anode chamber 407 is fed by the pump 404 from the electrolytic decontaminating cell 401 into the extractive separating bath 412 where the electrolyte 413 is stirred for a time by a motor-driven agitator 414 (FIG. 4) so that phosphoric acid is extracted by the solvent (S). After the agitator 414 has been stopped, the resultant solution after the extraction 415, separated and settled in the lower layer in the bath 412, is discharged through a discharge valve 416 into the cathode chamber 406. At this time, care must be taken so as not to discharge the solvent (S) in the upper layer into the cathode chamber 406 and this may be done by observing an electric conductivity meter 417 mounted at the lower outlet of the bath 412. Since the amount of the resultant solution after the extraction 415 is discharged is smaller than the capacity of the cathode chamber 406, the feed water valve 418 must be opened to add water to the upper limit level of the cathode chamber 406. A liquid level control 418*a* may be provided to automatically control the valve 418 and the liquid level.

After the feed water valve 420 at the outlet of a reservoir 419 is opened to supply the extractive separating bath 412 with an inverse extractive water 421, the agitator 414 is again actuated to mix the water with the solvent (S) in the bath 412, thereby inversely extracting phosphoric acid from the solvent (S). The agitator 414 is then stopped, and the resultant inverse extractive solution 422, separated and settled in the lower layer, is discharged through the discharge valve 423 into the anode chamber 407 to its upper limit level. Since the volume of the resultant inverse extractive solution 422 is larger than that of the decontaminating electrolyte 413, a major portion of the solution is left undischarged in the extractive separating bath 412.

When DC current is passed between the capture electrode 409 and the insoluble electrode 410 at this stage, hydrogen ions or cations in the solution are released in the form of a large amount of hydrogen gas on the capture electrode 409 in the cathode chamber 406 so that the pH value of the solution drops. Accordingly, phosphoric acid ions or anions move through the diaphragm 408 into the anode chamber 407 where they bond with hydrogen ions increased due to the generation of oxygen gas on the insoluble electrode 410, thus gradually raising the concentration of phosphoric acid in the solution. As the current flow is continued, the hydrogen ion concentration in the cathode chamber 406 is reduced to about pH 2. Then, the amount of hydrogen gas generated on the capture electrode 409 decreases and metallic ions begin to deposit on the capture electrode 409.

During this operation, the liquid level drops both in the cathode chamber 406 and anode chamber 407 because of the evaporation and decomposition of the water. Makeup water is automatically fed through the feed water valve 418 into the cathode chamber 406 and the resultant inverse extractive solution 422 left in the extractive separating bath 412 is automatically fed through the discharge valve 423 into the anode chamber 407 so as to compensate for the liquid loss. A liquid level control 423*a* may be mounted in the chamber 407 and connected to automatically control the valve 423. The conductivity meter 417 may also be connected to an automatic controller 417*a* that is connected to control the operation of the valve 423. The controller 417*a* would turn off the valve 423 when all of the solution 422 is drained from the bath 412.

When the electric conductivity meter 417 detects that the resultant inverse extractive solution 422 has been substantially all discharged from the extractive separating bath 412, the level control function is released and the discharge valve 423 is closed.

The current supply is continued, however, until substantially all of the metallic ions and the phosphoric acid ions are removed from the solution in the cathode chamber 406. The electrolyte 413 fed from the electrolytic decontaminating cell 401 is thus reproduced as a high concentration phosphoric acid solution of substantially the same volume. Water is supplied through a feed water valve 424 to the solution in the chamber 407, as required, to adjust the phosphoric acid concentration to that of the initial electrolyte before feeding the whole volume of the solution in the anode chamber 407 by the pump 411 back into the electrolytic decontaminating cell 401, thus completing the electrodeposition reproducing process.

Water almost as clear as fresh water is produced in the cathode chamber 406 during the electrodeposition reproducing process. After completing electrodeposition reproducing process, this clear water is fed by the pump 426 into the reservoir 419 so as to serve as part of the inverse extractive water to be used for the subsequent operation. Water is also supplied through the feed water valve 425 into the reservoir 419.

According to this method, the resultant solution after extraction 415 in the bath 412 contains a small percentage of phosphoric acid when it is discharged into the cathode chamber 406. In addition, the solution is further diluted by mekeup water supplied through the feed water valve 418. Therefore, the current flow is started with the cathode chamber 406 filled with a solution having a decreased hydrogen ion concentration. As a result, compared with the preceding example in which electrodeposition reproduction is performed with an electrolyte having a high hydrogen ion concentration contained in the cathode chamber 406, the length of time required before electrodeposition starts is remarkably reduced in this example.

Figure 6:
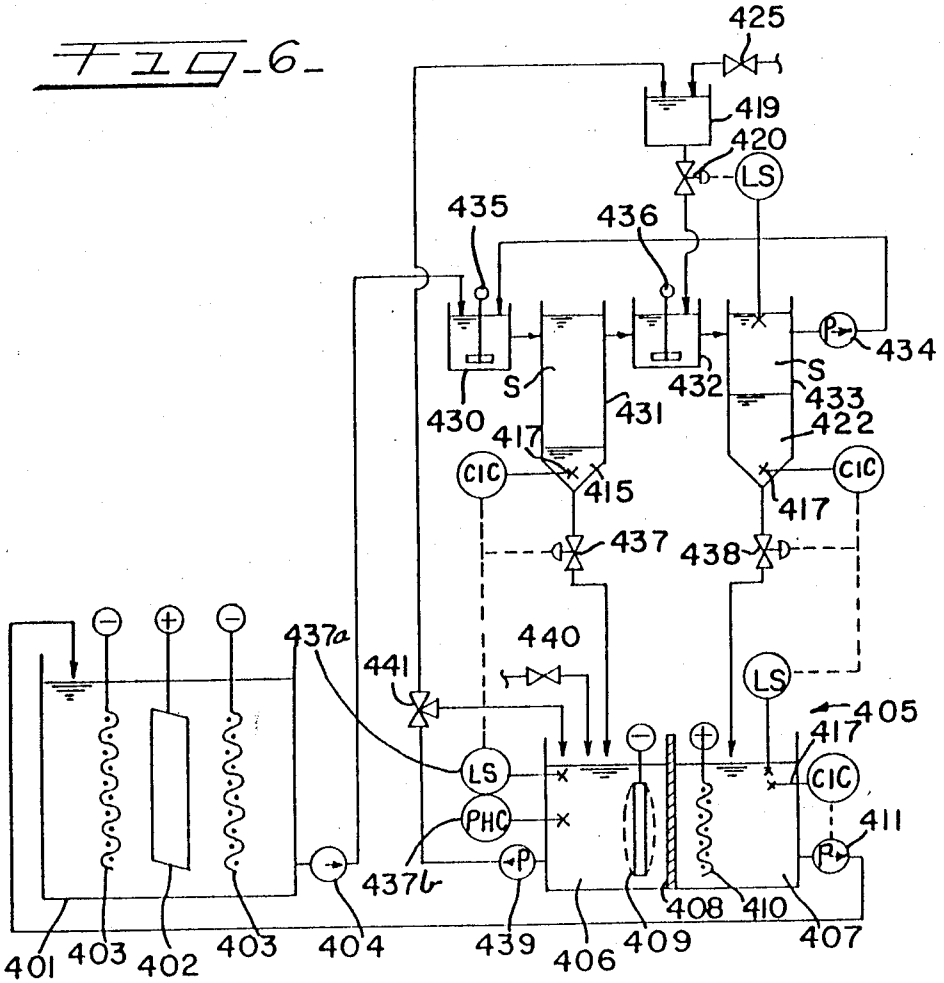

In the system shown in FIG. 6, extraction and inverse extraction of phosphoric acid as well as electrodeposition reproduction are performed continuously. Parts common to the system shown in FIG. 4 are referred to by the same numerals, and a discussion of the common subject matter is omitted here.

For the process of extraction and inverse extraction of phosphoric acid, an extracting bath 430, an extractive solution separating bath 431, an inverse extracting bath 432 and an inverse extractive solution separating bath 433 are separately installed in such a manner that the solution overflows from one bath to the next bath. The solvent (S) is continuously circulated by a pump 434 between the inverse extractive solution separating bath 433 and the extracting bath 430 and the solutions in the extracting bath 430 and the inverse extracting bath 432 are stirred at all times by the agitators 435, 436.

Electrolyte is continuously fed by the pump 404 from the electrolytic decontamination cell 401 into the extracting bath 430 where phosphoric acid is continuously extracted by the solvent (S). The resultant solution after extraction 415, separated and settled in the lower layer of the extractive solution separating bath 431, is sent through a supply valve 437 into the cathode chamber 406 so that the hydrogen ion concentration of the solution in the cathode chamber 406 is always maintained at pH 2. The solvent (S) flows from the extractive solution separating bath 431 to the inverse extracting bath 432 where phosphoric acid is back-extracted by water supplied through a feed water valve 420. The resultant inverse extractive solution 422, separated and settled in the lower layer of the inverse extractive solution separating bath 433, is sent through the supply valve 438 into the anode chamber 407, thereby controlling the liquid level in the anode chamber. The feed water valve 420 is operated in accordance with the level control in the inverse extractive solution separating bath 433 so that inverse extractive water is automatically supplied from the reservoir 419 into the inverse extracting bath 432 by the amount equivalent to the discharge of the resultant solution after the extraction 415 and the resultant inverse extractive solution 422.

Since the solution in the cathode chamber 406 is continuously circulated for agitation by the pump 439 while the resultant solution after extraction 415 is automatically supplied into the cathode chamber 406 so as to maintain the hydrogen ion concentration at about pH 2 at all time, metallic ions deposit for capture on the capture electrode 409 without delay. To compensate for the water loss due to decomposition and evaporation, makeup water is supplied through the feed water valve 440 so as to control the liquid level in the cathode chamber 406. If the resultant solution after extraction 415 is injected in a larger amount than the water loss, the liquid level in the cathode chamber 406 gradually rises. In such a case, pH control is released so as to stop the injection of the resultant solution after extraction 415, when the liquid level reaches the uppermost limit. A liquid level control 437*a* and a pH control 437*b* are connected to the chamber 406 and to a valve 437 in order to control the liquid level. While keeping current flowing, a valve 441 in the circulation line is opened to feed part of the solution from the cathode chamber 406 to the reservoir 419 so as to lower the liquid level when substantially no metallic ions and phosphoric acid ions are left in the liquid in the cathode chamber 406.

The resultant inverse extractive solution 422 is automatically supplied to compensate for the water loss in the anode chamber 407 while the solution in the anode chamber 407 is fed back into the electrolytic decontaminating cell 401 as reproduced electrolyte, through a pump 411 with the feed rate being controlled by means of the electric conductivity meter 417. Meanwhile, electrolyte is fed from the electrolytic decontaminating cell 401 into the extracting bath 430 in the same amount with the reproduced electrolyte fed back from the anode chamber 407 to the electrolytic decontaminating cell 401, thus continuously performing electrodeposition reproduction of electrolyte.

Similar to the system shown in FIG. 4, the resultant solution after extraction 415, whose phosphoric acid content is decreased, is injected into the cathode chamber 406 in this system. Therefore, compared with the method as described earlier in which the electrolyte is directly injected from the electrolytic decontaminating cell 401 into the cathode chamber 406, the electrodeposition reproducing capacity is improved in this example.

Moreover, according to the systems as shown in FIGS. 4 and 6, phosphoric acid in the decontaminating electrolyte fed from the electrolytic decontaminating cell 401 flows into the anode chamber 407 through extraction and inverse extraction processes, thus saving electric energy required for moving the phosphoric acid from the cathode chamber 406 through the diaphragm 408 to the anode chamber 407 during the process of electrodeposition reproduction. To raise the effect of extraction and inverse extraction of the phosphoric acid, a large volume of inverse extractive water may be used, which in turn leads the increase in the volume of the resultant inverse extractive solution 422 to be processed in the anode chamber 407, however. As a result, the speed of the electrodeposition reproduction is limited by the rate of water loss due to decomposition and evaporation in the anode chamber 407. This problem can be solved by incorporating evaporation into the process of concentrating phosphoric acid performed in the anode chamber 407. Heating the solution in the anode chamber 407, however, causes the functioning of the diaphragm 408 to be lowered, resulting in the leakage of hydrogen ions from the anode chamber 407 into the cathode chamber 406. If incorporating evaporation into the process of concentrating phosphoric acid, therefore, it is necessary to concentrate the resultant inverse extractive solution 422 prior to injecting it into the anode chamber 407 or to send the solution from the anode chamber 407 into an evaporator for concentrating the solution and to cool it before injection into the anode chamber 407.

Figure 7:
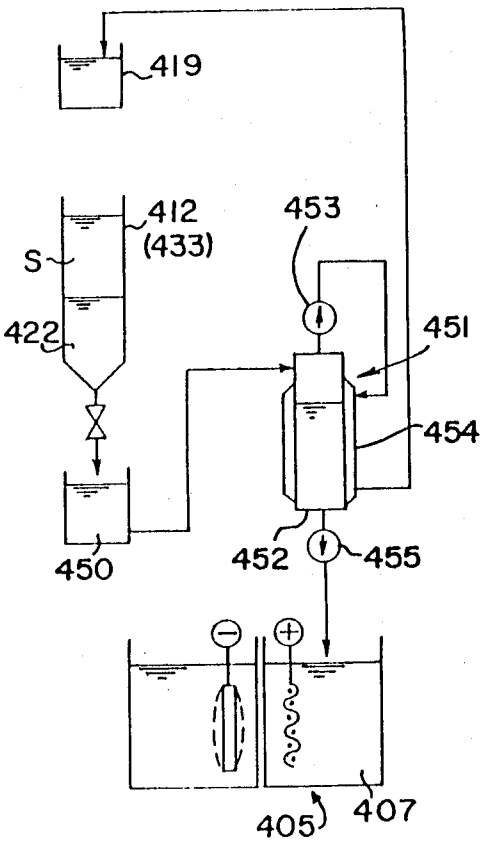

FIG. 7 shows a system in which evaporation is incorporated into the process of concentrating phosphoric acid in the resultant inverse extractive solution 422. In this system, the resultant inverse extractive solution 422 discharged from the extractive separating bath (412 or 433) into the receiver 450, is fed to a vapor compression concentrating unit 451 so as to concentrate the phosphoric acid. The concentrator 452 is a vessel or a pipe that is glass lined on its inner wall. A compressor 453 suctions vapor from the concentrator 452 for depressurization as well as compressing suctioned vapor and transfers compression heat to the solution in the concentrator 452 through the jacket 454 or a similar heat transferring tube provided with a glass liner on its outer wall so that the resultant inverse extractive solution 422 is concentrated by evaporation at a low temperature. Thus, concentration by evaporation is achieved with little energy consumption and without the need for a heat source or cooling water. The concentrated solution in the concentrator is suctioned off by a pump 455 into the anode chamber 407. The condensate is sent to the reservoir 419 to be used as inverse extractive water.

As described above, if evaporation is incorporated into the process of concentrating phosphoric acid in the resultant inverse extractive solution 422, power consumption required for electric decomposition of water can be saved and ample inverse extractive water can be used to ensure satisfactory extraction and inverse extraction. As a result, speed or efficiency of electrodeposition reproduction is further increased.

To verify the effect of the extraction and inverse extraction of phosphoric acid in this system, the following experiment was conducted with spent electrolyte obtained after the electrolytic decontamination of SUS 304 plate in 75% phosphoric acid electrolyte and with tributyl phosphate (TBP) as solvent.

40cc of TBP was poured into 10cc of the above-mentioned electrolyte so as to extract phosphoric acid. 50cc of water was poured into the resultant TBP obtained after extraction so as to inversely extract phosphoric acid. Then, 10cc of the above-mentioned electrolyte was poured into TBP recovered by the above inverse extraction. Thus, the process of extraction and inverse extraction was repeated. 10cc of electrolyte decreased to 7cc after extraction of phosphoric acid by 40cc of TBP which increased to 43cc. The 43cc of TBP then decreased to about 40cc, the initial volume, when recovered by adding 50cc of water for inverse extraction of phosphoric acid so that about 53cc of resultant inverse extractive solution was obtained.

Components as shown in the table below were contained in 10cc of the electrolyte (A) and 7cc of the resultant solution after extraction (B), 53cc of the resultant inverse extractive solution (C) and 40cc of the TBP recovered (D) by the 2nd and the 5th extraction and inverse extraction.

| Extraction # | Component | (A) mg | (B) mg | (C) mg | (D) mg |
|---|---|---|---|---|---|
| 2 | Fe | 243.5 | 230 | 15.2 | 0.096 |
| | Cr | 80.5 | 77.8 | 5.6 | <0.2 |
| | Ni | 14.6 | 14.4 | 0.6 | <0.02 |
| | Co | 0.46 | 0.44 | <0.02 | <0.004 |
| | Cu | 0.6 | 0.5 | 0.04 | <0.02 |
| | $H_3PO_4$ | 11700 | 5900 | 6830 | — |
| 5 | Fe | 243.5 | 192 | 17.4 | 0.168 |
| | Cr | 80.5 | 67.1 | 6.6 | <0.2 |
| | Ni | 14.6 | 12.7 | 0.65 | <0.02 |
| | Co | 0.46 | 0.37 | <0.026 | <0.004 |
| | Cu | 0.6 | 0.48 | 0.04 | <0.02 |
| | $H_3PO_4$ | 11700 | 5030 | 7100 | — |

As is obvious from the table, if phosphoric acid is extracted from the decontaminating electrolyte with 75% phosphoric acid content by recovered TBP of the amount four times the volume of the electrolyte and if phosphoric acid extracted and dissolved in TBP is inversely extracted by water of the same amount with TBP, more than one-half of the phosphoric acid in the electrolyte is transferred to the resultant inverse extractive solution so that the TBP is almost completely recovered. Similar effects of extraction and inverse extraction were also obtained by experiments conducted in the same manner for low concentration sulfuric acid electrolyte and for high concentration phosphoric acid-sulfuric acid electrolyte.

If the resultant solution after extraction and the resultant inverse extractive solution thus obtained are fed into the cathode chamber and the anode chamber, respectively, of the electrodeposition reproducing cell, electrodeposition reproduction performance is more than two times that by the method in the example as mentioned earlier.

The systems described herein are preferably operated with the temperature range of from approximately normal room temperature up to approximately 50° C. The diaphragms may be types that are well known to those skilled in the electrolysis art. In the system shown in FIG. 1, an unglazed ceramic plate may be used, and in the systems of FIGS. 2–4, 6 and 7, an ion exchange membrane may be used.

As described above, according to this example, phosphoric acid in the electrolyte is directly transferred into the anode chamber of the electrodeposition reproducing cell through the process of extraction and inverse extraction, thus reducing the time required for electrodeposition reproduction or increasing the electrodeposition reproduction capacity. In addition, reproduced electrolyte and solvent can be repeatedly used. This helps solve the problem of waste liquid disposal confronted by the electrolytic decontamination process involving high concentration acid electrolyte of phosphoric acid series which is effective in preventing contamination. Namely, the amount of radioactive secondary waste is significantly reduced. As described above, the methods of reproducing electrolyte in the electrolytic decontamination waste are described in various embodiments, but these methods are also available for the reproducing electrolyte in the chemical decontamination waste including radioactive metallic ions.

We claim:

1. A process of electrolytic decontamination of a metal object having a radioactively contaminated surface, comprising the stops of positioning the object and one or more electrodes in an electrolyte of an electrolytic decontaminating first cell, connecting a positive DC potential to said object and a negative DC potential to said electrodes so that they respectively operate as an anode and a cathode in the electrolyte, supplying DC current between said cathode and said anode to electrolytically polish the surface of the object, utilizing a metal ion isolating second cell which is divided by a diaphragm into an anode chamber having an insoluble electrode, and a cathode chamber having a capture electrode, supplying DC current between said insoluble electrode and said capture electrode through the diaphragm, circulating a decontaminating electrolyte between said first cell and the anode chamber of said second cell, and injecting the electrolyte from the anode chamber of said second cell into the cathode chamber of said second cell to maintain a hydrogen ion concentration therein to such an extent as to isolate metallic ions by electrodeposition on the capture electrode, and acid ions therein to move through the diaphragm into the circulating electrolyte in the anode chamber during the DC current flow.

2. The process as described in claim 1, wherein a sulfuric acid aqueous solution is used as the electrolyte of said cells, and wherein the electrolyte is injected from the anode chamber into the cathode chamber so as to maintain the hydrogen ion concentration of the electrolyte in the cathode chamber of said second cell not higher than pH 2.

3. A process for two step electrolytic decontamination of a radioactivity contaminated metal surface of an object, comprising the steps of removing the radioactivity from said radioactively contaminated metal surface by mounting the object as an anode in a first cell, using a diluted electrolyte that is relatively easy in waste disposal, and then mounting the object as an anode in a second cell for electrolytically polishing the surface by using an electrolyte that is effective in providing a relative luster on the metal surface.

4. A process for the reproduction of high concentration acid decontaminating electrolyte having been used, and whose service life is over, in an electrolytic decontamination of a radioactively contaminated object, said process comprising the steps of utilizing a reproduction cell which is divided by a diaphragm into an anode chamber and a cathode chamber of equal capacity, providing an insoluble electrode in said anode chamber and a capture electrode in said cathode chamber, supplying said anode chamber with electrically conductive initial electrolyte whose hydrogen ion concentration is adjusted to about pH 2 by the addition of an acid solution of the same components as said decontaminating electrolyte, supplying said cathode chamber with a spent electrolyte and supplying DC current through said diaphragm between said insoluble electrode and said capture electrode whereby, during operation, as the acid ions move into the anode chamber through the diaphragm, the metallic ions in the spent electrolyte are removed by deposition on said capture electrode in the cathode chamber, and the acid concentration of the electrolyte in said anode chamber is increased up to said initial electrolyte for reuse as a substantially metal-free high concentration electrolyte.

5. A process of the continuous reproduction of high concentration acid decontaminating electrolyte being used in electrolytic decontamination of a radioactively contaminated object, said process comprising the steps of dividing a reproducing cell by a diaphragm into an anode chamber having an insoluble electrode, and a cathode chamber having a capture electrode, said anode chamber being initially filled with an electrolyte of the same composition and concentration as the decontaminating electrolyte, and said cathode chamber being initially filled with water, supplying DC current through said diaphragm between said capture electrode and said insolable electrode, and injecting a decontaminating electrolyte of an electrolytic decontaminating cell into said cathode chamber of said reproducing cell to maintain a PH value therein approximately at 2 at all times while the DC current flows, allowing radioactive metal ions in the cathode chamber to deposit on the capture electrode, and obtaining a metal-free high concentration acid solution in the anode chamber to be reused as a reproduced electrolyte, maintaining a liquid level in said anode and cathode chambers of the reproducing cell by supplying water during the reproducing operation, and returning the reproduced electrolyte obtained in said anode chamber of the reproducing cell back into the electrolytic decontamination cell by the amount equal to the decontaminating electrolyte being injected into the cathode chamber of the reproducing cell.

6. The process of continuous reproduction of decontaminating electrolyte as described in claim 5, wherein the object having been decontaminated in the electrolytic decontaminating cell is rinsed first by using the solution in the cathode chamber in the electrodeposition reproducing cell.

7. A process for the reproduction of a decontaminating electrolyte of high concentration phosphoric acid series used for electrolytic decontamination of radioactively contaminated objects, utilizing extraction ad inverse extraction of phosphoric acid before feeding the decontaminating electrolyte into a reproducing cell, said process comprising the steps of extracting phosphoric acid from the decontaminating electrolyte using a solvent, injecting the extracted electrolyte into a cathode chamber of an electrodeposition reproducing cell, inversely extracting a phosphoric acid from said solvent by water for use as an initial electrolyte, injecting the inverse extracted solution into an anode chamber of the reproducing cell, said reproducing cell being divided by a diaphragm into an anode chamber having an insoluble electrode, and a cathode chamber having a capture electrode, supplying DC current through the diaphragm between the insoluble electrode and the capture electrode in said reproducing cell, thereby capturing metallic ions by electrodeposition in said cathode chamber as well as increasing Phosphoric acid concentration of the solution in the anode chamber upto that of the initial electrolyte to be reused as a decontaminating electrolyte.

8. The process as decribed in claim 7 in which tributyl phosphate is used as the phosphoric acid extracting solvent.

9. The process as described in claim 7 in which the solution obtained by electrodeposition reproduction in the cathode chamber is used as inverse extractive water.

10. The process as described in claim 7 in which evaporation is incorporated into the process of concentrating phosphoric acid in the resultant inverse extractive liquid.

11. Apparatus for electrolytic decontamination of a metal object having a radioactively contaminated metal surface, comprising an electrolytic decontaminating first cell, the object to be decontaminated and one or more electrodes being dipped in an electrolyte of said first cell, a positive DC potential and a negative DC potential being connected to said object and electrodes so that they respectively operate as an anode and a cathode when DC current is passed between said object and electrodes to electrolytically polish the metal surface of the object, a separate metallic ion isolating second cell being partitioned by a diaphragm into an anode chamber having an insoluble electrode and a cathode chamber having a capture electrode, means for circulating a decontaminating electrolyte between said first cell and said anode chamber of said second cell, and means for injecting the electrolyte from the anode chamber of said second cell into said cathode chamber of said second cell to maintain hydrogen ion concentration therein to such an extent as to isolate metallic ions by deposition on the capture electrode, and acid ions therein to move into the circulating electrolyte in the anode chamber through the diaphragm during the DC current flow.

12. A process as described in claim 7, wherein one extracting separating bath is employed, said process further comprising the steps of:

supplying the decontaminating electrolyte into an extracting separating bath, said cath being filled with extracting solvent, discharging the extracted electrolyte into the cathode chamber of the reproducing cell and adding water to the upper level of the chamber, supplying water to the extracting separating bath for inverse extraction of phosphoric acid from the solvent, discharging inverse extracted aqueous solution into the anode chamber of the reproducing cell by a level control, and supplying D.C. current between the insoluble electrode and the capture electrode of the reproducing cell.

13. A process as described in claim 7, utilizing a continuous extraction and inverse extraction process, said process comprising the steps of:

installing an extraction and inverse extraction apparatus including an extracting bath, an extractive solution separating bath, an inverse extracting bath, and an inverse extractive separating bath being positioned at the same level above the reproducing cell so that the solution overflows from one to the next bath, said apparatus being filled with an extractive solvent, continuously circulating solution between the inverse extractive separating bath and the extracting bath, supplying decontaminating electrolyte of the electrolytic decontaminating cell into the extracting bath, supplying inverse extracting water into the inverse extracting bath by a level control, injecting the extracted electrolyte of the extractive solution separating bath into the cathode chamber of the reproducing cell so as to always maintain PH value about 2, injecting inverse extracted solution of the inverse extractive solution separating bath into the anode chamber of the reproducing cell by a level control, supplying D.C. current between the insoluble electrode and the capture electrode of the reproducing cell, and returning the solution of the anode chamber, whose acid solution is increased up to that of the initial electrolyte, to the electrolytic decontamination cell.

14. A process as described in claim 10, wherein a vapor compression concentrator with a glass-lined interior wall is employed for the concentration of phosophoric acid so that evaporation can be achieved at low temperature.

15. Apparatus as described in claim 11, wherein a sulfuric acid aqueous solution is used as the electrolyte of said cells, and wherein the electrolyte is injected from the anode chamber into the cathode chamber so as to maintain the hydrogen ion concentration of the electrolyte in the cathode chamber of said second cell not higher than pH 2.

16. Apparatus for the reproduction of spent electrolyte of a high concentration acid solution having been used in electrolytic decontamination of a radioactively contaminated object, said apparatus comprising a reproducing cell being partitioned by a diaphragm into an anode chamber and a cathode chamber of equal capacity, said anode chamber being initially filled with an initial electrolyte formed by an electrically conductive aqueous solution whose hydrogen ion concentration is adjusted to substantially pH 2, means for injecting a spent electrolyte into said cathode chamber from an electrolyte decontamination cell, an insoluble electrode being dipped in said solution of the anode chamber, and a capture electrode being dipped in the spent electrolyte of the cathode chamber, means for injecting the solution from said anode chamber into said cathode chamber, and means for supplying DC current through the diaphargm between said insoluble electrode and said capture electrode, whereby, as the acid ions of the spent electrolyte move into the cathode chamber through the diaphragm, radioactive ions in the cathode chamber are removed by electrodeposition on the capture electrode, and acid concentration in the anode chamber is increased up to that of the initial electrolyte to be reused in the electrolytic decontamination.

17. Apparatus for the continuous reproduction of a high concentration acid electrolyte being used for an electrolytic decontamination of a radioactively contaminated object in an electrolytic decontamination cell, said apparatus comprising a reproducing cell being partitioned by a diaphragm into an anode chamber having an insoluble electrode, and a cathode chamber being a capture electrode, said anode chamber being initially filled with a metal-free electrolyte of the same composition and concentration as the decontaminating electrolyte, and said cathode chamber being initially filled with water, means for supplying DC current between said capture and insoluble electrodes through said diaphragm, means for injecting the decontaminating electrolyte from an electrolytic decontamination cell into said cathode chamber of the reproducing cell so that the pH value therein is maintained about 2 at all times while the DC current flows, means for keeping a liquid level in said anode and cathode chambers by supplying make-up water to compensate for the water loss due to evaporation and decomposition of water during the operation, and means for injecting the reproduced electrolyte from said anode chamber of the reproducing cell into said electrolytic decontamination cell by the same amount as the decontaminating electrolyte being injected from said electrolytic decontamination cell into the cathode chamber of the reproducing cell.

18. The apparatus as described in claim 7, wherein the object having been decontaminated in the electrolytic decontaminating cell is rinsed first by using the solution in the cathode chamber in the electrodeposition reproducing cell.

19. Apparatus for reproduction of decontaminating electrolyte of high concentration phosphoric acid series being used for electrolytic decontamination of radioactively contaminated objects, utilizing extraction and inverse extraction of phosphoric acid, said apparatus comprising an electrodeposition reproducing cell being divided by a diaphragm into an anode chamber having an insoluble electrode, and a cathode chamber having a cathode electrode, means for extracting phosphoric acid from a radioactive decontaminating electrolyte using a solvent, means for inversely extracting phosphoric acid from said solvent by water, means for injecting the extractive phosphoric acid solution into said cathode chamber, and inversely extracted phosphoric acid solution into said anode chamber of the reproducing cell, said inversely extracted phosphoric acid solution forming an initial electrolyte, and means for supplying DC current between a capture electrode of the reproducing cell and said insoluble electrode, thereby removing metallic ions by electrodeposition on the capture electrode in said cathode chamber as well as increasing the phosphoric acid concentration of the solution in the anode chamber up to that of the initial electrolyte to be reused in the decontamination cell.

20. The apparatus as described in claim 19 in which tributyl phosphate is used as said phosphoric acid extracting solvent.

21. The apparatus as described in claim 19 in which the solution obtained by electrodeposition reproduction in the cathode chamber is used as inverse extractive water.

22. The apparatus as described in claim 19 in which evaporation is incorporated into the means for concentrating phosphoric acid in the resultant inverse extractive liquid.

23. Apparatus as described in claim 16, and further comprising:

an extracting separating bath, in which extraction and inverse extraction of phosphoric acid are performed, said bath being filled with a solvent, means for supplying a decontaminating electrolyte into the extracting separating bath for phosphoric acid extraction means for supplying extracted electrolyte into the cathode chamber of the reproducing cell, means for supplying water into the extracting separating bath for inverse extraction of phosphoric acid from the solvent, means for supplying inverse extracted aqueous solution into the anode chamber of the reproducing cell by level controlling, and means for supplying D.C. current between the insoluble electrode and the capture electrode, thereby removing metallic ions from the cathode chamber and increasing acid concentration in the anode chamber for reuse.

24. Apparatus as described in claim 16, wherein the extraction and the inverse extraction of phosphoric acid as well as electrodeposition reproduction of decontaminating electrolyte are performed continuously, said apparatus comprising:

extraction and inverse extraction apparatus including an extracting bath, an extractive solution separating bath, an inverse extraction bath, and an inverse extractive separating bath being positioned above the reproducing cell in such a manner that the solution overflows from one to the next bath, said apparatus being filled with extracting solvent, means for circulating solution between the inverse extractive separating bath and the extracting bath, means for supplying decontaminating electrolyte from the electrolytic decontamination cell into the extracting bath for extraction of phosphoric acid, means for supplying water into the inverse extracting bath for inverse extraction of phosphoric acid from the solvent, means for injecting extracted electrolyte of the extractive solution separating bath into the cathode chamber of the reproducing cell and maintaining the PH value of the solution therein at about 2 at all times, means for injecting the inverse extracted aqueous solution from the inverse extractive solution separating bath into the anode chamber of the reproducing cell by level controlling, means for supplying D.C. current between the insoluble electrode and the capture electrode of the reproducing cell, and means for returning a reproduced electrolyte from the anode chamber into the electrolytic decontamination cell by the amount equal to the decontaminating electrolyte being injected into the extracting bath.

25. Apparatus as described in claim 19, wherein a vapor compression concentrator having glass-lined inner wall is employed for concentrating phosphoric acid in the inverse extractive liquid at low temperature.

* * * * *